US005971815A

United States Patent [19]

Polgar et al.

[11] Patent Number: 5,971,815

[45] Date of Patent: Oct. 26, 1999

[54] ELECTRICAL CONNECTOR WITH TERMINAL LOCKING MEMBER

[75] Inventors: Gary E. Polgar, Bolingbrook; Rupert J. Fry, Mount Prospect, both of Ill.

[73] Assignee: Molex Incorporated, Lisle, Ill.

[21] Appl. No.: 09/039,864

[22] Filed: Mar. 16, 1998

[51] Int. Cl.[6] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 4,200,350 | 4/1980 | Zimmerman, Jr. . | |
| 4,679,874 | 7/1987 | Saijo et al. | 439/595 |
| 4,705,337 | 11/1987 | Maeda | 439/595 |
| 4,711,508 | 12/1987 | Sueyoshi | 439/595 |
| 4,867,712 | 9/1989 | Kato et al. | 439/752 |
| 4,946,399 | 8/1990 | Kawashima | 439/752 |
| 4,979,913 | 12/1990 | Aiello et al. | 439/596 |
| 5,066,253 | 11/1991 | Kameyama | 439/752 |
| 5,160,283 | 11/1992 | Fry et al. | 439/752 |
| 5,316,504 | 5/1994 | Jinno | 439/752 |
| 5,474,477 | 12/1995 | Aoyama | 439/752 |
| 5,647,775 | 7/1997 | Polgar et al. | 439/752 |
| 5,651,704 | 7/1997 | Fukushima et al. | 439/752 |
| 5,653,613 | 8/1997 | Shimoda | 439/752 |

*Primary Examiner*—Gary Paumen
*Attorney, Agent, or Firm*—Stephen Z. Weiss

[57] ABSTRACT

An electrical connector includes a dielectric housing having a terminal-receiving cavity extending in an insertion direction. The housing includes a window in an outer wall communicating with the cavity. A terminal is insertable into the cavity in the insertion direction to a final position. The terminal includes a stop surface transverse to the insertion direction and alignable with the window when the terminal is in its final position. A terminal locking member has a locking projection adapted to pass through the window into the cavity in engagement with the stop surface on the terminal to lock the terminal in the cavity. The locking projection includes a latching portion engageable with a latch surface on the housing to latch the locking member to the housing. Therefore, the locking projection performs a dual function of locking the terminal in the housing and latching the terminal locking member to the housing.

10 Claims, 4 Drawing Sheets

ELECTRICAL CONNECTOR WITH TERMINAL LOCKING MEMBER

FIELD OF THE INVENTION

This invention generally relates to the art of electrical connectors and, particularly, to an electrical connector which incorporates a locking member for locking a terminal in a connector housing.

BACKGROUND OF THE INVENTION

Typical electrical connectors include housings normally of insulating material and having a plurality of cavities or passages into which male or female terminals are inserted. In a hard wired connector, each terminal normally is pre-crimped to a wire conductor and then inserted into a housing cavity where it is retained in place by a locking structure. Typically the locking structure may include resilient tangs or latch projections which engage shoulders on the housing within the cavity. Mating plug and socket housings then can be joined in order to interconnect mating male and female terminals mounted in the housings, or the housings might be joined with other terminal supporting devices.

Although connectors of the character described above have been successfully used for many years, unreliable interconnections between the terminals can occur in some instances. For example, a terminal may not be fully inserted into its housing cavity during assembly whereby the locking structure is not effective to secure the terminal in place. When the terminal is joined with a mating terminal, the incompletely mounted terminal can be pushed out of position so that the interconnection between terminals is not made. In addition, even if a connection is made initially, a terminal can subsequently work loose because of vibrations or other extraneous forces and cause a faulty or intermittent connection. Consequently, a variety of systems have been designed wherein a separate terminal locking member is employed on the connector housing to act as either a primary or a second locking means. These locking members are inserted longitudinally or laterally into the connector housing.

One of the problems with employing a separate terminal locking member on the connector housing is that separate latch means often are required to prevent the locking member from simply falling off of the housing. For instance, exterior latch arms, such as cantilevered latch arms, often are used on the locking member for embracing the housing and engaging appropriate latch bosses on the outside of the housing. Such latch means add to the overall size or envelope of the housing which often is undesirable. This increased size or envelope of the overall connector further is compounded if the connector, itself, is inserted into a shroud, for instance. Because of the exterior latch arms of the terminal locking member, the shroud becomes enlarged and increases the overall size or envelope of the overall assembly. Some connectors solve this problem by moving the latch means or arms of the TPA to the interior of the connector housing. However, this often is not a real solution, because there was insufficient room within the housing in the first instance, and the net result is that the housing, itself, is expanded to accommodate the interior latch means and, therefore, results in enlarging the connector envelope anyway.

The present invention is directed to solving the above problems by providing a unique terminal locking member which includes a locking component which performs the dual function of locking the terminal in the housing as well as latching the terminal locking member in the housing.

SUMMARY OF THE INVENTION

An object, therefore, of the invention is to provide a new and improved electrical connector which includes a terminal locking member.

In the exemplary embodiment of the invention, the electrical connector generally includes a dielectric housing having a forward mating end, a rearward terminating end, an elongated terminal-receiving cavity extending in an axial direction between the ends, a latch surface at the cavity, and a window in an outer side wall of the housing communicating with the cavity. An elongated terminal is insertable into the cavity in the axial direction to a final position. The terminal includes a forward contact end, a rearward terminating end and an intermediate portion between the ends. The intermediate portion includes a stop surface transverse to the axial direction and alignable with the window when the terminal is in its final position.

The invention contemplates a terminal locking member having a locking projection adapted to pass through the window into the cavity in engagement with the stop surface on the terminal to lock the terminal in the cavity. The locking projection includes a latching portion engageable with the latch surface of the housing to latch the locking member to the housing. Therefore, the locking projection on the terminal locking member performs the dual function of locking the terminal in the housing and latching the terminal locking member to the housing, thereby obviating separate undesirable latches.

As disclosed herein, the stop surface is defined by a transverse wall of the terminal, and the locking projection comprises a block positionable behind the transverse wall. The latching portion projects transversely outwardly of the block. Preferably, a pair of the latching portions project outwardly of the block for engaging a pair of the latch surfaces on opposite sides of the cavity. In the preferred embodiment, the block has a pair of legs which straddle the terminal, and the pair of outwardly projecting latching portions are disposed on the outsides of the legs.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
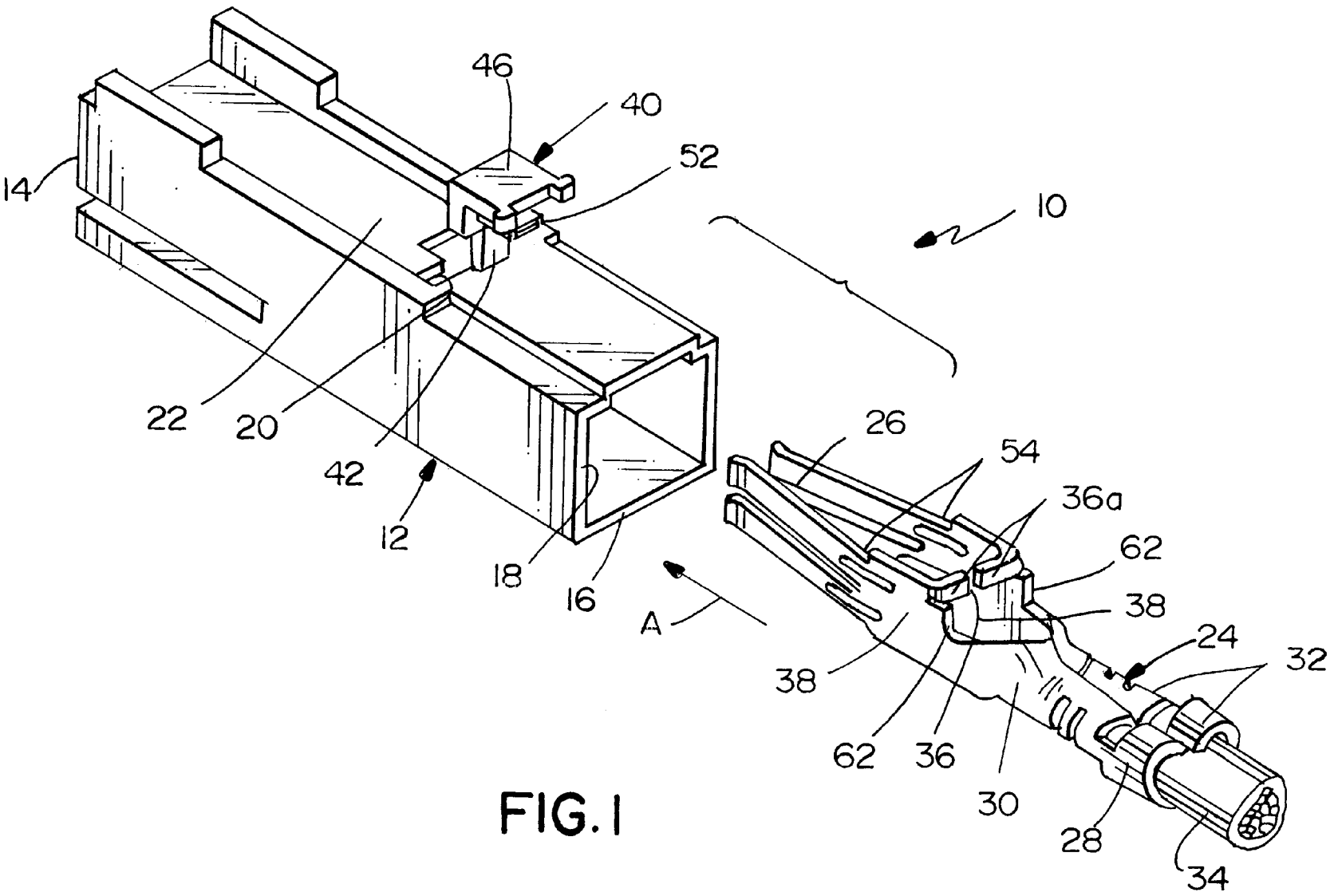
FIG. 1 is a perspective view of an electrical connector incorporating a terminal locking member according to the invention.
Figure 2:
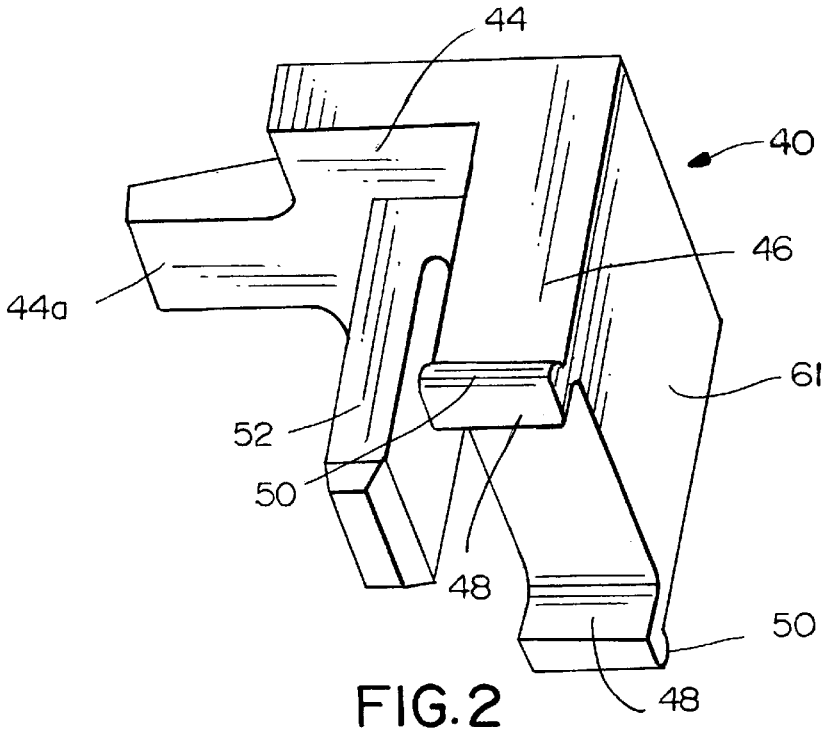
FIG. 2 is a perspective view of the terminal locking member.
Figure 3:
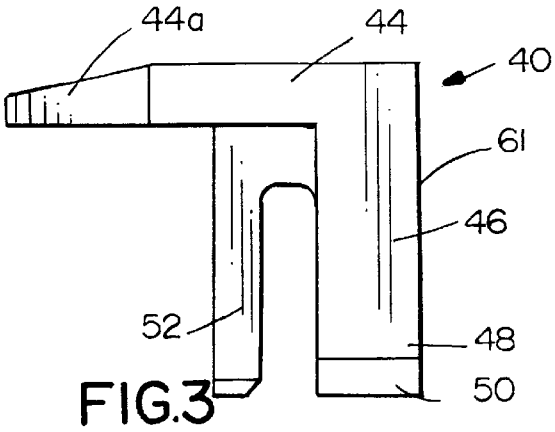
FIG. 3 is a side elevational view of the terminal locking member.
Figure 4:
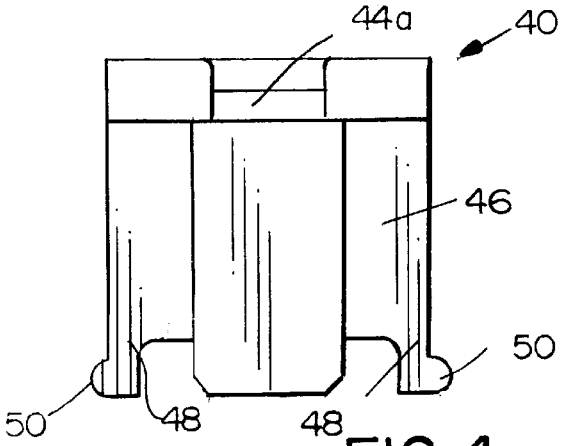
FIG. 4 is an elevational view looking toward the left-hand side of FIG. 3.
Figure 5:
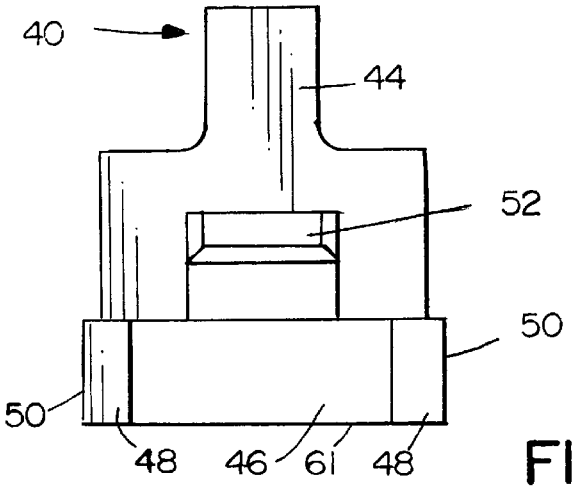
FIG. 5 is a bottom plan view of the terminal locking member.

Referring to the drawings in greater detail, and first to FIG. 1, the invention is embodied in an electrical connector, generally designated 10, which includes a dielectric housing, generally designated 12. The housing is unitarily molded of dielectric material such as plastic or the like. The housing has a forward mating end 14 and a rearward terminating end 16. An elongated terminal-receiving cavity 18 extends in an axial direction between the ends. A window in an outer wall 22 of the housing communicates with cavity 18.

Still referring to FIG. 1, an elongated terminal, generally designated 24, is insertable into cavity 18 in housing 12 in an axial direction as indicated by arrow "A". The terminal includes a forward contact end 26, a rearward terminating or conductor-engaging end 28 and an intermediate body portion 30 between the ends. The terminating end has two pairs of crimp arms 32 for crimping onto a conductor 34, such as an insulated electrical wire. Body portion 30 has a wall, generally designated 36, transverse to axial direction "A" and alignable with window 20 of cavity 18 when the terminal is in its final inserted position described hereinafter. The terminal is stamped and formed of sheet metal material, and body portion 30 includes a pair of transversely spaced side walls 38. The transverse wall 36 is formed from portions 36*a* of each side wall 38 bent inwardly toward each other. In essence, transverse wall 36 defines a stop surface transverse to axial direction "A" and alignable with window 20 when terminal 24 is in its final inserted position shown hereinafter.

Referring to FIGS. 2–5 in conjunction with FIG. 1, a terminal locking member, generally designated 40, is molded integrally with housing 12 by a frangible web 42 as seen in FIG. 1. The web prevents the terminal locking member from separating from the housing and becoming lost during shipping and handling, prior to use in locking the terminal within the housing. When the locking member is ready for use, it is separated from the housing by breaking frangible web 42.

Locking member 40 includes a top wall 44 having a thumb tab portion 44*a*. A locking projection or block 46 depends from top wall 44. As will be seen hereinafter, the locking projection is wider than terminal 24 and includes a pair of depending legs 48 which straddle opposite sides of the terminal. A rounded latching portion or boss 50 projects transversely outwardly of each leg 48 for latching the locking member in the housing, as will be seen hereinafter. Finally, a narrower projection or boss 52 depends from the bottom of top wall 44 spaced forwardly of locking projection 46.

Figure 6:
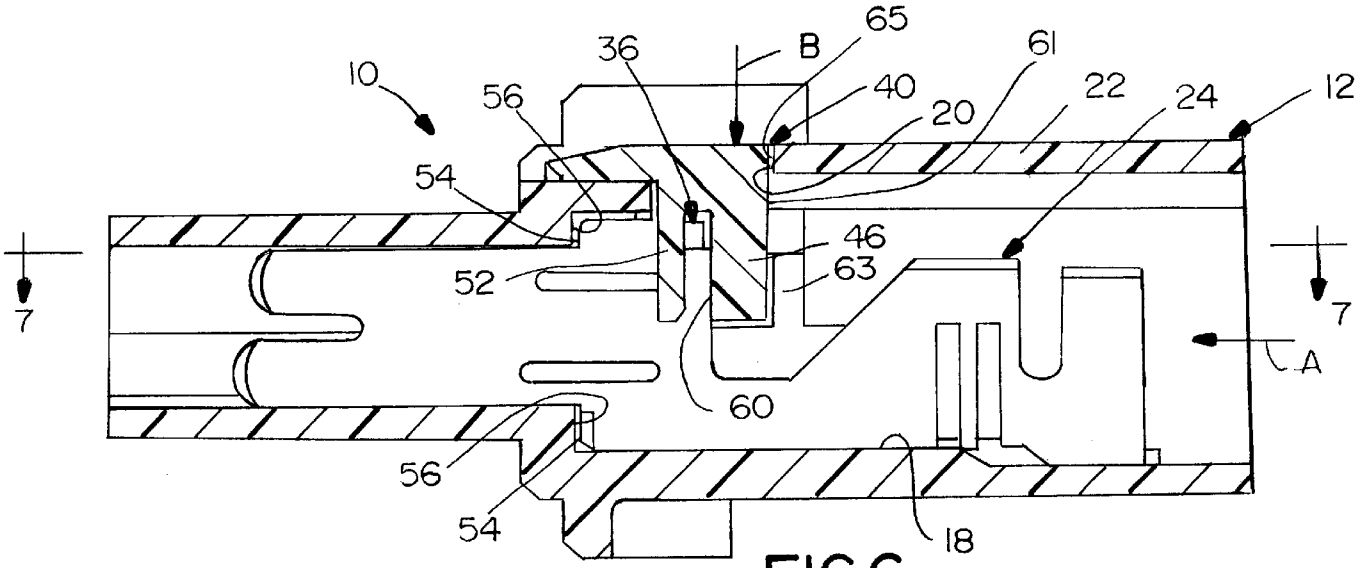
FIG. 6 is a vertical axial section through the electrical connector, with the terminal locking member inserted to its fully locked position relative to an inserted terminal.
Figure 7:
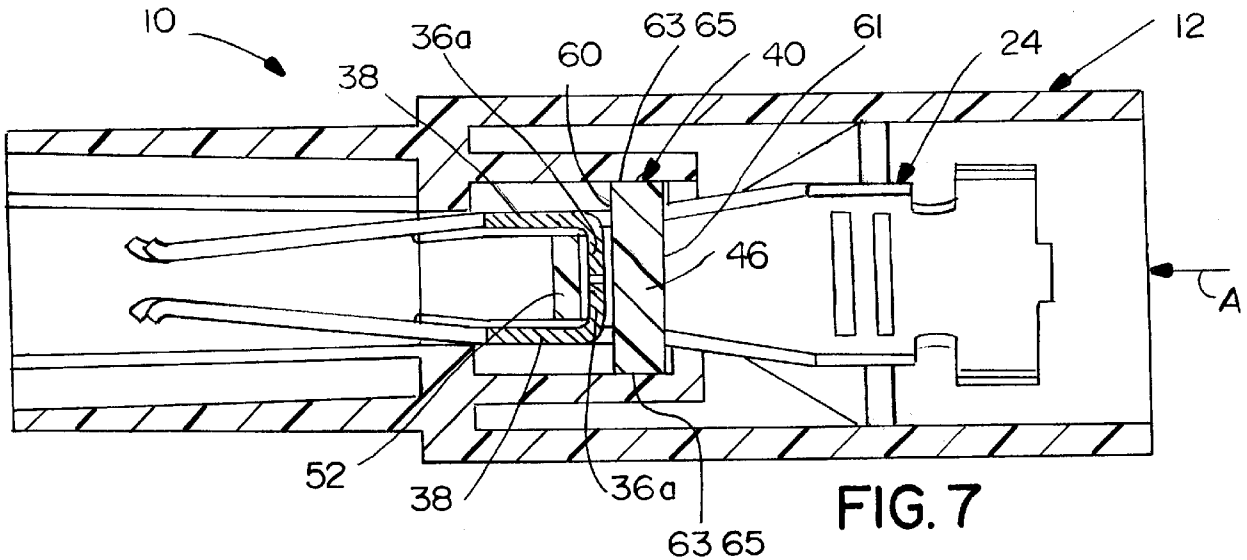
FIG. 7 is a horizontal section taken generally along line 7—7 of FIG. 6.

FIGS. 6 and 7 show terminal 24 inserted into cavity 18 of housing 12 to its final inserted position. When finally inserted, forwardly facing abutment shoulders 54 at the top and bottom front corners of the side walls of terminal 24 engage stop shoulders 56 at the top and bottom of cavity 18 to define the fully inserted position of the terminal.

Whereas terminal 24 is inserted into cavity 18 in the axial direction as indicated by arrow "A" in FIG. 6, terminal locking member 40 is inserted transverse to the axial direction through window 20 in top wall 22 of the housing so that locking projection 46 moves behind transverse wall 36 of the terminal. As stated above, transverse wall 36 defines a stop surface on the terminal and, as seen in FIGS. 6 and 7, locking projection 46 defines a forwardly facing stop surface 60 for engaging transverse wall 36. Therefore, the terminal is locked in its final inserted position, because locking projection 46 prevents the terminal from being pulled out of cavity 18 opposite the direction of arrow "A". When the terminal locking member is in its fully locked position as shown in FIGS. 6 and 7, the forwardly spaced second projection 52 of the locking member is disposed in front of transverse wall 36 and between side walls 38 of the terminal to stabilize the terminal in its final position. Also rearwardly facing stop surface 61 of locking projection 46 engages shoulder 63 and rear edge 65 of window 20 which prevents locking projection 46 from being pulled out of cavity 18 opposite the direction of arrow "A".

Figure 8:
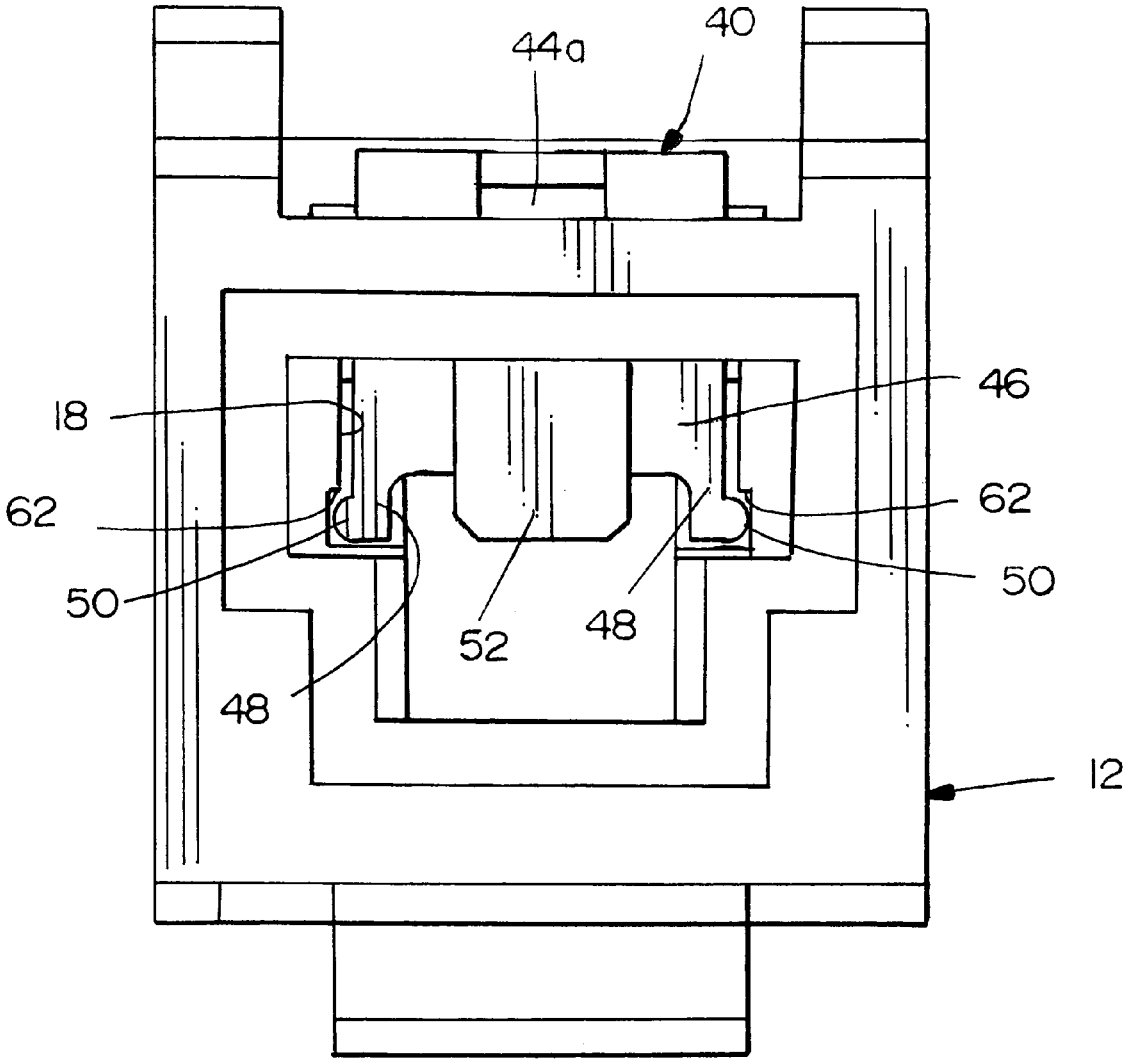
FIG. 8 is an end elevational view of the locking member in its final position within the connector housing, with the terminal removed to facilitate the illustration of the latch means between the locking member and the housing.

Referring to FIG. 8 particularly in conjunction with FIGS. 6 and 7, when terminal locking member 40 is in its fully inserted, locked position, rounded latching portions 50 projecting transversely outwardly of legs 48 snappingly engage behind a pair of latch shoulders or surfaces 62 at opposite sides of cavity 18. With the terminal locking member being molded of plastic material, when the locking member is inserted into the housing, rounded latching portions 50 engage the side walls of cavity 18 and flex legs 48 inwardly until the latching portions pass shoulders 62, whereupon the legs bias the latching portions transversely outwardly into latching engagement behind the shoulders to hold the terminal locking member in its position within the housing. Likewise the rounded latching portion 50 on flexible legs 48 sliding over shoulder 62 allows for the removal of the locking member 40 with the upward movement of the thumb tab portion 44*a*.

From the foregoing, it can be understood that locking projection 46, with its integral latching portions 50, performs a dual function of locking terminal 24 within housing 12 as well as latching terminal locking member 40 within the housing. Therefore, extraneous exterior or interior latching means, such as latch arms, are not required which, otherwise, would unduly enlarge the overall size or envelope of the electrical connector and its associated apparatus.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing having a forward mating end, a rearward terminating end, an elongated terminal-receiving cavity extending in an axial direction between the ends, a latch surface at the cavity, and a window in an outer side wall of the housing communicating with the cavity;

an elongated terminal insertable into the cavity in said axial direction to a final position and including a forward contact end, a rearward terminating end and an intermediate portion between the ends, the intermediate portion including a stop surface transverse to said axial direction and alignable with the window when the terminal is in said final position; and a terminal locking member having a locking projection adapted to pass through the window into the cavity in engagement with the stop surface on the terminal to lock the terminal in the cavity, the locking projection including a latching portion engageable with said latch surface to latch the locking member to the housing, whereby the locking projection performs a dual function of locking the terminal in the housing and latching the terminal locking member to the housing;

wherein said stop surface is defined by a transverse wall of the terminal, and the locking projection comprises a block positionable behind the transverse wall; and wherein said latching portion projects transversely outwardly of said block.

2. The electrical connector of claim 1, including a pair of said latching portions projecting outwardly of the block for engaging a pair of said latch surfaces on opposite sides of the cavity.

3. The electrical connector of claim 2 wherein said block has a pair of legs which straddle the terminal, and said pair of outwardly projecting latching portions are disposed on the outsides of the legs.

4. The electrical connector of claim 1 wherein said locking projection includes a pair of legs which straddle the terminal.

5. The electrical connector of claim 4, including a pair of said locking portions disposed respectively on said pair of legs for engaging a pair of said latch surfaces on opposite sides of the cavity.

6. An electrical connector, comprising:

a dielectric housing having a terminal-receiving cavity extending in an insertion direction, a latch surface at the cavity and a window in an outer wall of the housing communicating with the cavity;

a terminal insertable into the cavity in said insertion direction to a final position and including a stop surface transverse to said insertion direction and alignable with the window when the terminal is in said final position; and a terminal locking member having a locking projection adapted to pass through the window into the cavity in engagement with the stop surface on the terminal to lock the terminal in the cavity, the locking projection including a latching portion engageable with said latch surface to latch the locking member to the housing, whereby the locking projection performs a dual function of locking the terminal in the housing and latching the terminal locking member to the housing;

wherein said stop surface is defined by a transverse wall of the terminal, and the locking projection comprises a block positionable behind the transverse wall; and wherein said latching portion projects transversely outwardly of said block.

7. The electrical connector of claim 6, including a pair of said latching portions projecting outwardly of the block for engaging a pair of said latch surfaces on opposite sides of the cavity.

8. The electrical connector of claim 7 wherein said block has a pair of legs which straddle the terminal, and said pair of outwardly projecting latching portions are disposed on the outsides of the legs.

9. The electrical connector of claim 6 wherein said locking projection includes a pair of legs which straddle the terminal.

10. The electrical connector of claim 9, including a pair of said locking portions disposed respectively on said pair of legs for engaging a pair of said latch surfaces on opposite sides of the cavity.

* * * * *